US009651338B2

(12) United States Patent
Theisinger

(10) Patent No.: US 9,651,338 B2
(45) Date of Patent: May 16, 2017

(54) SCOPE ADJUSTMENT DEVICE

(71) Applicant: SUPAS LTD, Hong Kong (CN)

(72) Inventor: Hermann Theisinger, Vienna (AT)

(73) Assignee: SUPAS LTD, Hong Kong (CN)

( * ) Notice: Subject to any disclaimer, the term of this patent is extended or adjusted under 35 U.S.C. 154(b) by 0 days.

(21) Appl. No.: 14/630,903

(22) Filed: Feb. 25, 2015

(65) Prior Publication Data

US 2015/0241171 A1 Aug. 27, 2015

Related U.S. Application Data

(60) Provisional application No. 61/945,080, filed on Feb. 26, 2014, provisional application No. 61/982,253, filed on Apr. 21, 2014.

(51) Int. Cl.
*F41G 1/38* (2006.01)

(52) U.S. Cl.
CPC ..... *F41G 1/38* (2013.01)

(58) Field of Classification Search
CPC ..... F41G 1/38
USPC ..... 42/122, 119, 130; 359/424, 398
See application file for complete search history.

(56) References Cited

U.S. PATENT DOCUMENTS 2,392,979 A * 1/1946 Douden ..... G02B 27/34 250/467.1
5,497,266 A * 3/1996 Owen ..... G02B 17/0808 348/164
5,824,942 A * 10/1998 Mladjan ..... F41G 1/48 42/105
7,121,036 B1 * 10/2006 Florence ..... F41A 17/08 42/111
7,124,531 B1 * 10/2006 Florence ..... F41A 17/08 42/111
7,210,262 B2 * 5/2007 Florence ..... F41G 1/32 42/132
7,292,262 B2 * 11/2007 Towery ..... F41G 1/54 348/139
7,578,091 B2 * 8/2009 Klepp ..... G02B 23/00 42/111
7,581,346 B2 * 9/2009 Klepp ..... G02B 23/00 42/111
8,064,132 B1 * 11/2011 LeBlanc ..... G02B 23/10 359/399
8,081,291 B2 * 12/2011 Campbell ..... G02B 5/3083 349/200

(Continued)

FOREIGN PATENT DOCUMENTS

AU 2011202780 1/2012
CA 2743103 12/2011

(Continued)

*Primary Examiner* — Michael David
(74) *Attorney, Agent, or Firm* — ATIP Law; Ian Burns

(57) ABSTRACT

A riflescope is provided with a detachable digital ocular lens group that enables vision enhancement functions, e.g. night vision, zoom, etc while being replaceable with a regular ocular group in the event of power failure or faulty components. To ensure accuracy of the digital ocular lens group, a non-visible marker, e.g. IR marker, may be placed on a reticle that can be detected by a photo-sensor of the digital ocular. A processor can use the detected position of the marker to calibrate the digital display of the digital ocular.

13 Claims, 10 Drawing Sheets

(56) References Cited

U.S. PATENT DOCUMENTS

| | | | | |
|---|---|---|---|---|
| 8,336,776 | B2 * | 12/2012 | Horvath | F41G 1/38 235/400 |
| 8,881,981 | B2 | 11/2014 | Millett | |
| 9,057,586 | B2 * | 6/2015 | Wagner | F41G 1/38 |
| 9,140,521 | B2 | 9/2015 | Millett | |
| 9,250,036 | B2 | 2/2016 | Farca et al. | |
| 2004/0088898 | A1 * | 5/2004 | Barrett | F41G 1/38 42/119 |
| 2006/0010760 | A1 | 1/2006 | Perkins et al. | |
| 2007/0159701 | A1 * | 7/2007 | Campbell | G02B 5/3083 359/676 |
| 2007/0240356 | A1 * | 10/2007 | Klepp | F41G 1/38 42/122 |
| 2007/0277421 | A1 | 12/2007 | Perkins et al. | |
| 2008/0066364 | A1 * | 3/2008 | Klepp | F41G 1/38 42/122 |
| 2011/0207089 | A1 * | 8/2011 | Lagettie | F41G 3/2627 434/22 |
| 2011/0296733 | A1 | 12/2011 | York | |
| 2012/0000979 | A1 * | 1/2012 | Horvath | F41G 1/38 235/407 |
| 2012/0118955 | A1 * | 5/2012 | Cox | F41G 1/38 235/404 |
| 2012/0126002 | A1 * | 5/2012 | Rudich | F41G 11/001 235/404 |
| 2013/0228618 | A1 | 9/2013 | Millett | |
| 2013/0232846 | A1 * | 9/2013 | Wagner | F41G 1/38 42/119 |
| 2014/0041277 | A1 * | 2/2014 | Hamilton | F41G 1/345 42/122 |
| 2015/0128472 | A1 * | 5/2015 | Theisinger | F41G 1/38 42/122 |
| 2015/0138633 | A1 * | 5/2015 | Theisinger | F41G 1/38 359/399 |

FOREIGN PATENT DOCUMENTS

| | | |
|---|---|---|
| CN | 102057246 | 5/2011 |
| CN | 104246420 | 12/2014 |
| DE | 112007000314 | 1/2009 |
| EP | 1748273 | 1/2007 |
| EP | 2402704 | 1/2012 |
| IL | 213531 | 4/2014 |
| TW | 201337203 | 9/2013 |
| WO | WO2008045129 | 4/2008 |
| WO | WO2013165497 | 11/2013 |
| WO | WO2014084926 | 6/2014 |

* cited by examiner

SCOPE ADJUSTMENT DEVICE

CROSS REFERENCE TO RELATED APPLICATIONS

This application claims priority to U.S. provisional patent application Ser. Nos. 61/945,080 filed 26 Feb. 2014 and 61/982,253 filed 21 Apr. 2014, the contents of which are herein incorporated by reference.

FIELD OF THE INVENTION

The present invention relates to attachments for scopes and in particular, though not exclusively, for firearm scopes.

BACKGROUND

Telescopic sights such as riflescopes are used in any light conditions from bright daylight through lowest light conditions including night time uses. In order to view or aim in lowest light conditions the user typically connects additional analogue or digital Night-Vision instruments either to the objective or to the ocular of the telescopic sight. Also the user has to choose a specific optical power setting (fixed power) or a specific zoom range (variable power scope) thus limiting the application range of the telescopic sight overall. Typically, the user has to select one specific aiming mark which cannot be adapted to the situation. The aiming mark can only be set to one specific zero-setting with no adaptability for different shooting distances, wind conditions, inclination, canting and other external factors effecting shooting precision in the field. In the case of fully digital riflescopes or sights the aiming mark is totally dependable of the digital function thus not allowing for a use of the product without power or in case of defect of the electronics.

What is required is a system and method for improving the adaptability of scope systems.

SUMMARY OF ONE EMBODIMENT OF THE INVENTION

Advantages of One or More Embodiments of the Present Invention

The various embodiments of the present invention may, but do not necessarily, achieve one or more of the following advantages:

- the ability to modify the optical properties of a scope;
- provide an interface for detachment of an ocular;
- provide a digital take-down ocular;
- provide calibration for an ocular; and
- provide one or more secondary aiming marks.

These and other advantages may be realized by reference to the remaining portions of the specification, claims, and abstract.

Brief Description of One Embodiment of the Present Invention

In one aspect of the present invention, there is a provided a riflescope comprising a main housing, an objective group, a first reticle comprising at least one physical reticle mark and a detachable digital ocular group. The objective group may include at least one objective lens disposed toward an objective end of the main housing. The detachable digital ocular group may include a second housing attachable to and detachable from an ocular end of the main housing, a photo-sensor, at least one processor and a digital display. The photo sensor may be configured to receive light that has entered the objective end of the main housing and the processor may be programmed to process the light received by the photo sensor and to display an image representative of the received light on the digital display.

The detachable digital ocular group may be replaceable with an unpowered ocular group comprising a third housing attachable to and detachable from an ocular end of the main housing and one or more second ocular optical elements disposed within the third housing.

The first reticle may comprise one or more marker materials that are not visible to an operator of the riflescope during normal use of the riflescope.

In one aspect of the present invention, there is provided a riflescope comprising main housing means for housing a plurality of lens elements, objective lens means for providing at least one objective lens element, reticle means for providing at least one reticle and detachable digital ocular lens means for providing a digital ocular lens group. The digital ocular lens means may comprise second housing means for attaching to the main housing means and for housing the digital ocular lens group, photo-sensor means for sensing light through the riflescope, processor means for processing the light sensed by the photo-sensor means, and digital display means for displaying a digital image.

In one aspect of the invention, there is provided a method for calibrating a riflescope comprising a reticle, a photo-sensor, at least one processor and a digital display. The method may comprise receiving light from a marker at an image plane of the reticle into the photo-sensor. The processor may process the received light to detect a location of the marker. The processor may calibrate the digital display from the detected location of the marker.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present innovation shows a way of how to convert a conventional riflescope into a full day- and night riflescope by means of interchangeable eye pieces (optical and digital). Also it is presented how to change a fixed optical power setting and a given optical zoom range by means of a digital zoom function. Also it is presented how to support the user in adapting to different shooting distances, wind conditions inclination, canting and other factors by means of a secondary aiming mark which is superimposed over the optical image. Also the present riflescope concept allows for use without power (optical eye piece) or in case of electronics defect or weak batteries (with optical eye piece only).

Figure 1:
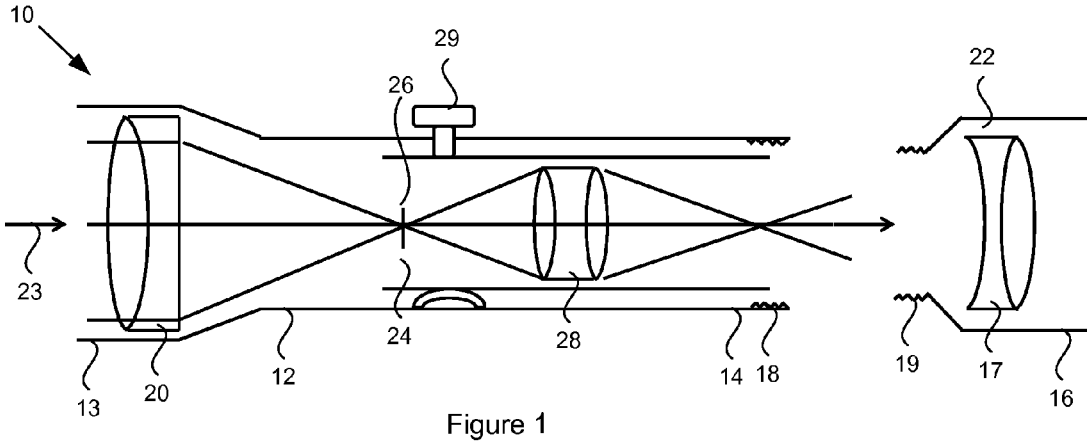
FIG. 1 substantially shows a riflescope with a detached non-powered ocular group.

In FIG. 1, there is shown a riflescope 10. The riflescope 10 includes a housing comprising a main housing 12 having an objective end 13 and an ocular end 14. A second housing 16 is attachable to and detachable from the main housing at the ocular end 14. The second housing 16 may attach/detach from the main housing 12 through various attachment mechanisms including, without limitation, complementary screw threads 18, 19, bayonet fittings, clips or other suitable connection mechanisms that may or may not require the use of tools etc.

Within the main housing there is shown an objective group comprising one or more objective lens elements that direct light 23 entering the housing through the objective end 13 toward a first image plane 24. A reticle 26 may be disposed in or near the first image plane 24. The reticle 26 may include one or more reticle marks as will be described in greater detail below. The placement of the reticle 26 may be adjustable through one or more adjustment mechanisms 29, as is known in the art. The main housing 12 also houses an erector group 28 which may include one or more erector elements such as, without limitation, an erector prism.

Figure 2:
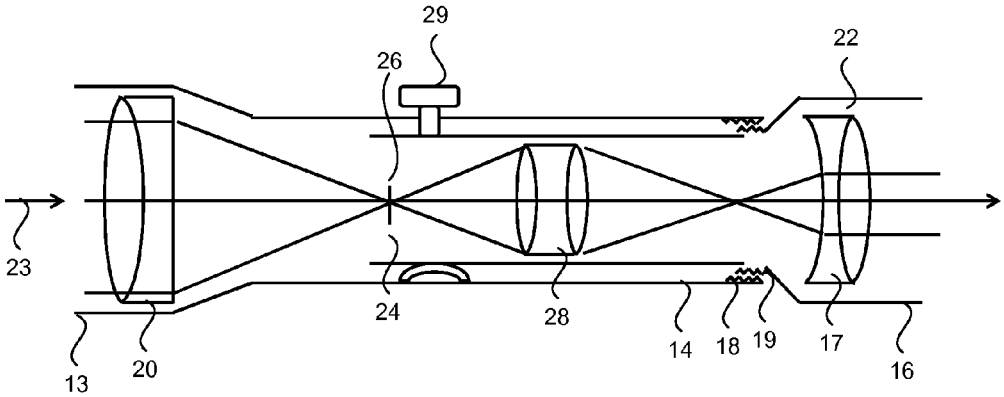
FIG. 2 substantially shows the riflescope of FIG. 1 with the ocular group attached.

FIG. 1 shows the ocular group housing 16 detached from the main housing 12 while FIG. 2 shows the ocular group housing 16 attached to the main housing 12 with engagement between the complementary screw threads 18, 19. The ocular group housing 16 houses one or more ocular optical elements 17 in a non-powered arrangement, thus providing an ocular group 22. The specific elements of the non-powered ocular group 22 may be regarded as conventional and thus no further description of the non-powered ocular group is considered necessary herein. The non-powered ocular group 22 may be adapted to the scope for use under primarily daytime or well-lit conditions or for use with other night-time accessories.

Figure 3:
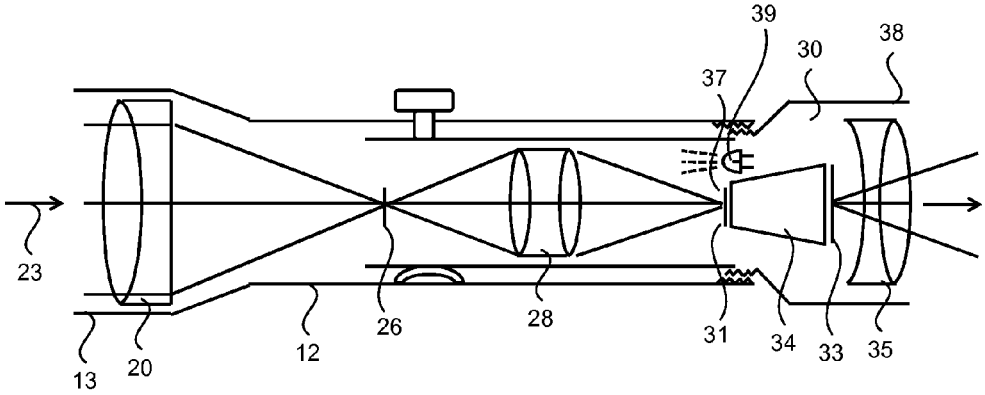
FIG. 3 substantially shows a riflescope with a detachable powered ocular group.

FIG. 3 shows the non-powered ocular group 22 replaced by a powered ocular group 30 in accordance with one embodiment of the present invention. The components of the powered ocular group 30 are disposed within a housing 38 that is attachable to and detachable from the main housing 12 in the same manner as for the non-powered ocular housing 16 described above. The powered ocular group 30 includes, with respect to the direction of light travel 23 through the riflescope, a photo sensor board 31 comprising one or more photosensors disposed at a second image plane 37, a digital display 33 and one or more optical elements 35 that magnify the image of the display 33 for projection to the user through the ocular end of the housing 38. The powered ocular group also includes an electronics group 34 including at least one processor, a memory for storing a program or instructions executable by the at least one processor, and associated circuitry. The photo sensor 31 may include a CCD, CMOS-sensor (or similar) and is configured to receive light that has entered the riflescope from the objective end 13 of the main housing 12 and passed through the objective 20 and erector groups 28. The electronics group 34 is programmed to process the light received by the photo sensor 31 and to display an image representative of the received light on the digital display 33. The representative image displayed on the digital display 33 does not necessarily need to be an exact reproduction of the image received at the photo sensor 31 but instead may include one or more enhancements, such as, without limitation, night vision enhancements, magnification, suppression or enhancement of specific aspects or areas of the image, digital overlays (e.g. of targeting marks), etc. The digital display 33 may include a very low threshold (display) to avoid blinding user's eye in lowest light conditions.

A control panel (not shown) may be provided on an external surface of the powered ocular housing 38 to enable a user to input control commands to the electronics group 34. Example control commands include, without limitation, display commands, calibration commands, preference settings, etc. Specific operations may include, without limitation ON/OFF selection, display brightness control, electronic aiming mark selection, remote control for an external device such as handlamps or infra-red illuminators and other functions One or more additional optical elements (not shown) may be placed in front of the photo sensor 31, with respect to the direction of light travel through the riflescope, if required to achieve the imaging functions of the riflescope.

Figure 4:
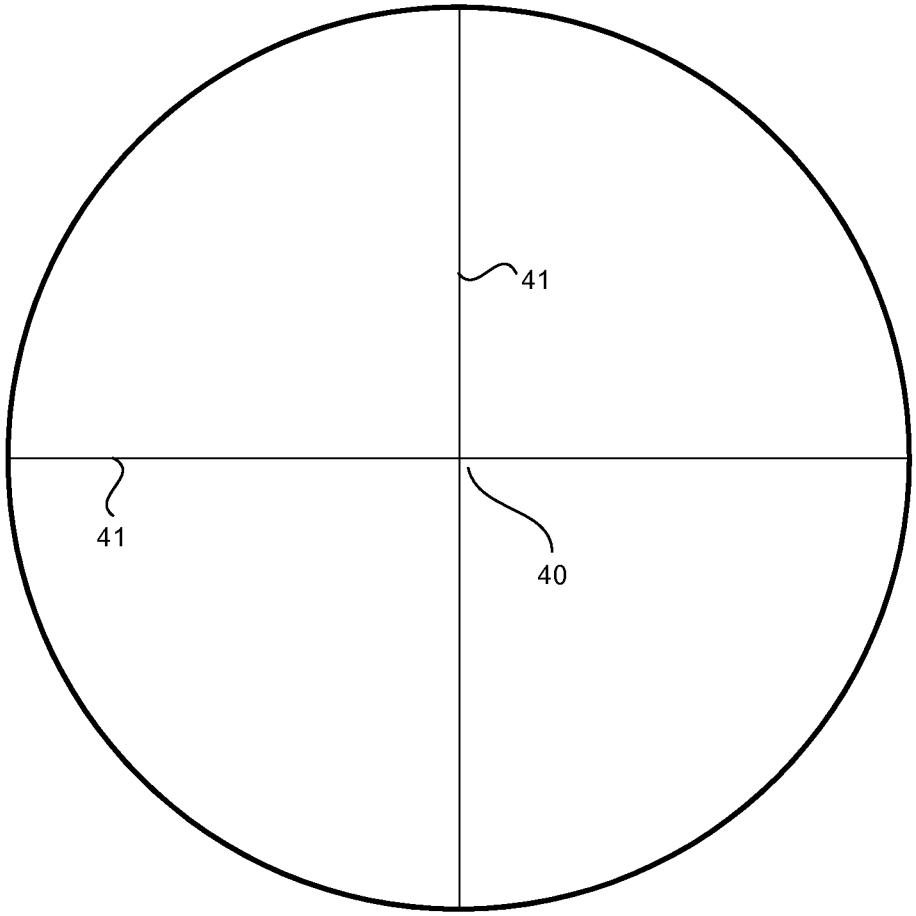
FIG. 4 substantially shows a view of the reticle in the first image plane.
Figure 5:
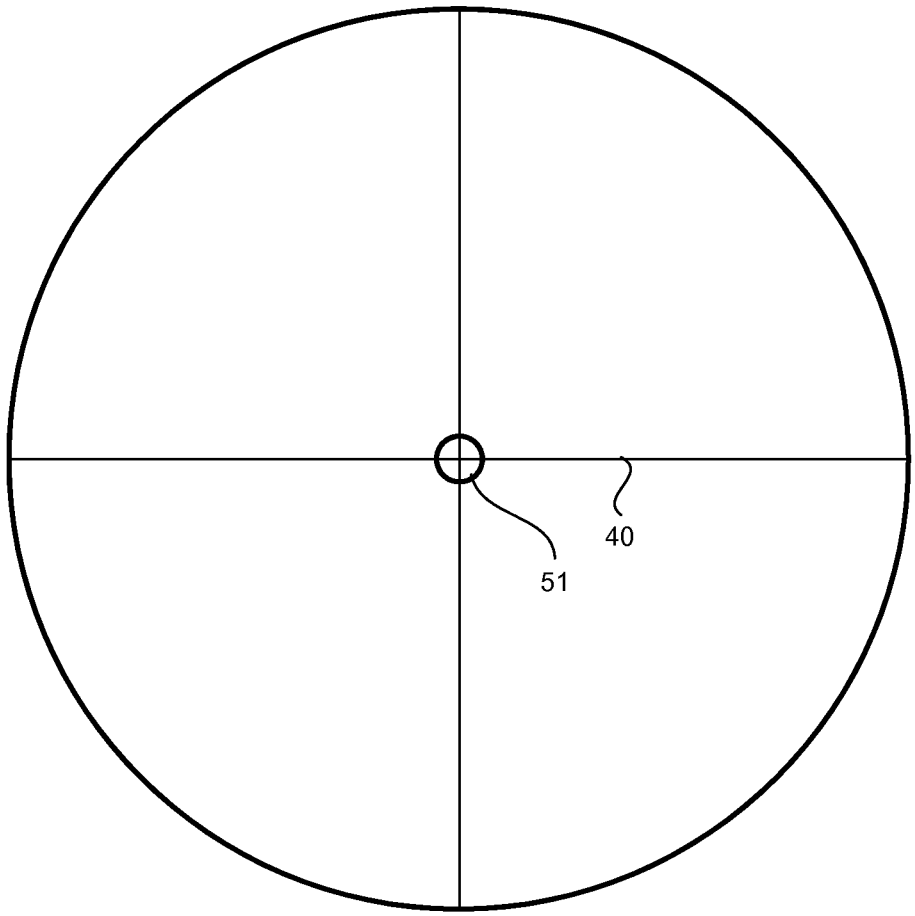
FIG. 5 substantially shows a view of the reticle with a digital overlay.
Figure 6:
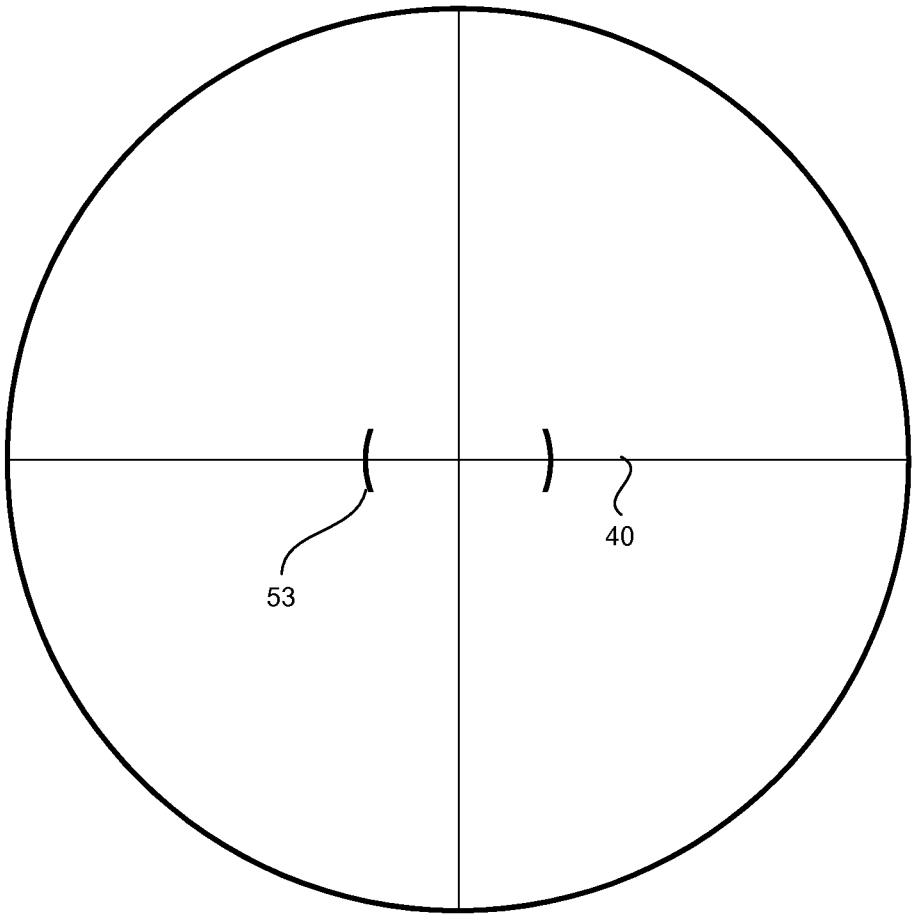
FIG. 6 substantially shows an alternative digital overlay.
Figure 7:
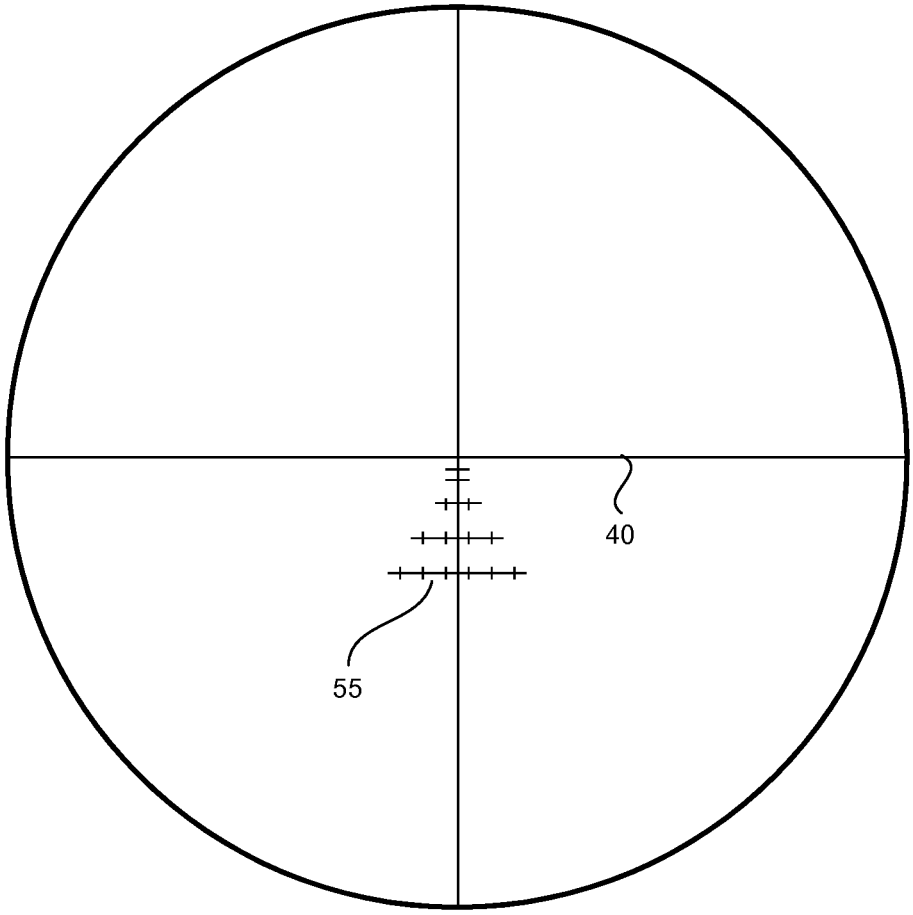
FIG. 7 substantially shows a second alternative digital overlay.
Figure 8:
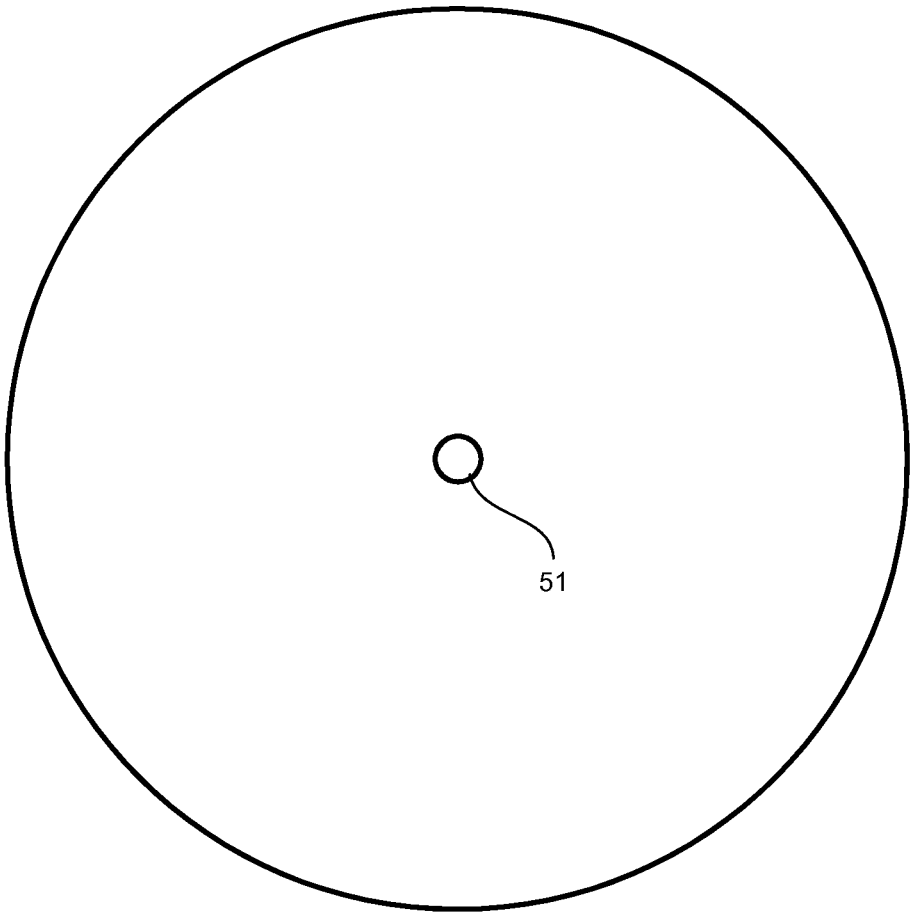
FIG. 8 substantially shows the reticle view with digital suppression of the cross hairs.

An example view through the riflescope from the ocular end is shown in FIG. 4. The view of FIG. 4 shows the reticle featuring conventional cross hair marks 40 including horizontal 41 and vertical lines 42. Other reticle marks will be apparent to a person skilled in the art. The lines 41, 42 are visible to the user during normal use of the riflescope using either the conventional ocular group 20 or the powered ocular group 30. In addition to the cross hair marks 40, the electronics group may be configured to digitally overlay one or more secondary aiming marks at the second image plane 37, i.e. in the plane of the photosensors. FIG. 5 shows a representation through the ocular in which the cross hair 40 in the first image plane has been overlaid with a circle aiming mark 51 in the second image plane. FIG. 6 shows a first alternative in which lead marks 53 are digitally laid over the 1st image plane reticle while FIG. 7 shows digitally overlaid ballistic holdover lines. FIG. 8 depicts an example in which the processing software of the electronics group 34 digitally suppresses the image of the first image plane cross hairs 40 on the digital display 33. In various embodiments, the digital ocular group delivers more than one aiming mark type such as circles, donuts, small crosses, posts, cones, arrows, dots or similar. In various embodiments, the digital ocular delivers secondary aiming marks to correct for bullet drop, inclination, altitude, temperature, humidity, geo-position (all: hold-over lines), cross wind (wind marks) or moving game aiming point error (lead marks).

In one embodiment, the digital ocular delivers the above information as data displayed on the micro display.

The provision of a detachable digital ocular that can be replaced by a conventional ocular group ensures that the riflescope remains functional in the event of a power or electronics failure of the digital ocular. However, the detachability of the digital ocular can introduce new sources of error and inaccuracy due to potential misalignment of the digital ocular housing 38 with the main riflescope housing 12. Any high quality riflescope should aim to deliver a total opto-mechanical tolerance of 1 MoA (minute of angle) during regular use of the product, which includes zooming, usual temperature changes, zeroing-in and shooting with g-forces around 1,000 g within a 1 to 2 ms peak time.

Any movement of operating parts, temperature changes or shocks through heavy recoil will change the mechanical cross hair position against the optical system—in the above described embodiments in a first image plane (1st IP) position—causing a tracking out of the correct zeroing-in location.

Further adding to this dilemma, the mechanical interface between the main housing 12 and the ocular housing 38 can cause substantially more movement of the ocular-eye piece when in use than with a conventional one-piece riflescope housing. By means of a massive, high-precision construction, the additional tolerance deviation may be kept fairly low, but would force the product into additional mass that would make the product too heavy for a competitive riflescope.

Figure 9:
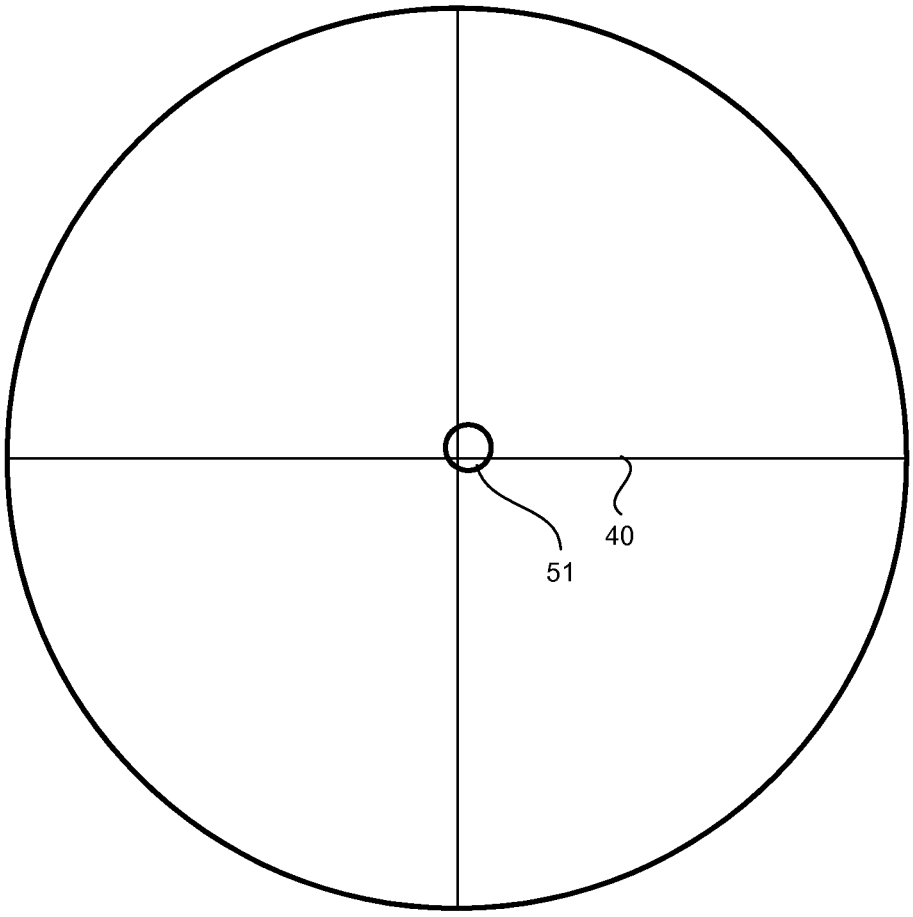
FIG. 9 substantially shows an offset between the cross hairs of the first image plane and the digital overlay.

The additional mechanical interface of the detachable ocular adds to the total tolerance deviation in a way that the alignment of the 2nd image plane-reticle 37 against the 1st image plane reticle 26 may miss the 1 MoA-target for quality riflescopes. Even more so, the movement of all critical parts against each other will become visible as both image planes 24, 37 are carrying a reticle in which smallest micrometer movements are typically magnified 4- to 16-times the size. Consequently shot by shot fired, the digital aiming mark will inevitably 'jump around' the 1st image plane-reticle which itself keeps moving as described above. FIG. 9 depicts an example in which the digitally overlaid circle 51 is dislocated relative to the cross hairs 40 of the first image plane reticle 26.

The described detachable ocular tolerance dilemma occurs mainly through shooting (shock), through handling the eye piece (e.g. lifting the rifle-optics set by the ocular and the resulting leverage effect hereof), through changing the eye piece (repetition error), through temperature changes (expansion) but also through other forces that effect the alignment of the ocular against the objective-erector system unit (riflescope 'body').

To keep the described factors within the 1 MoA quality corridor typically requires sophisticated designs, highest grade materials and tightest tolerances down to a few micrometers on specific parts such as the erector system which can add significantly to construction costs and/or weight.

Figure 10:
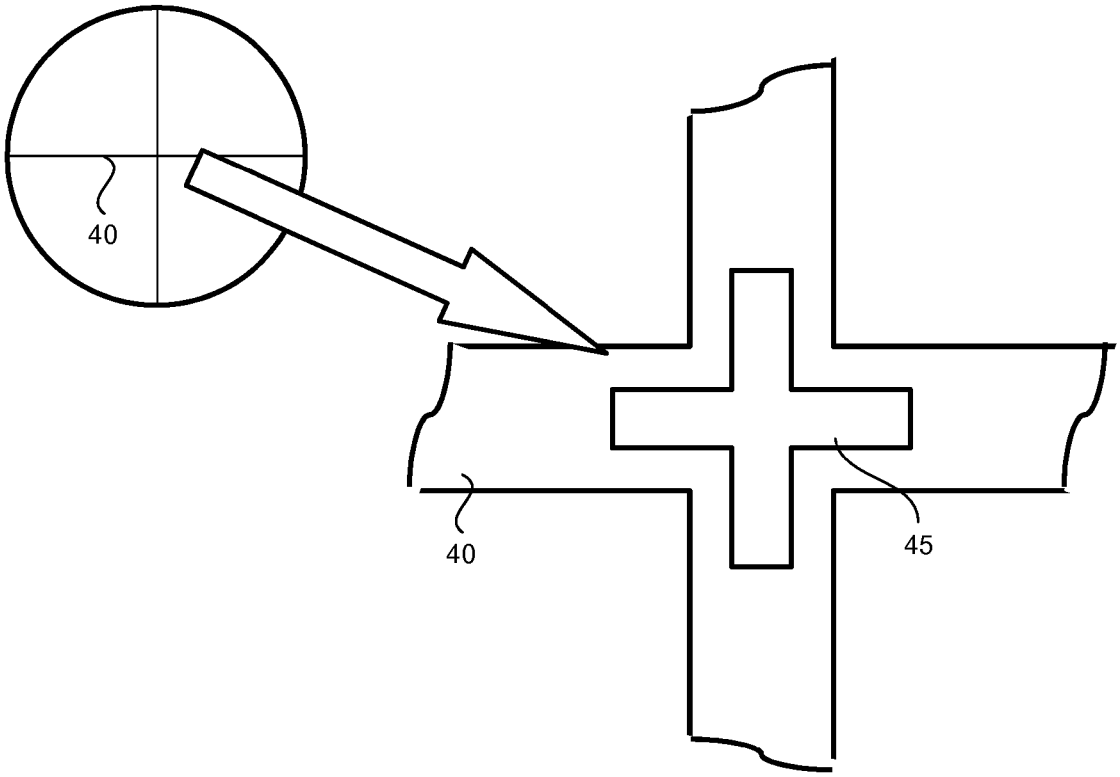
FIG. 10 substantially shows a first marker in the first image plane.
Figure 11:
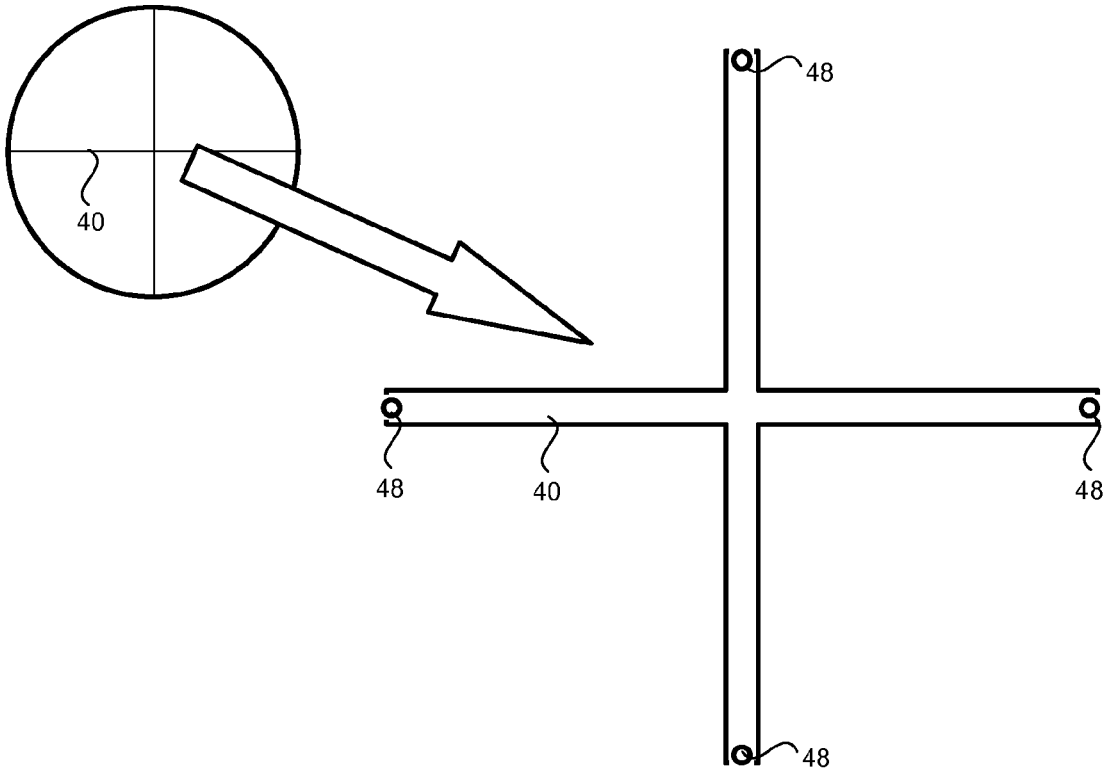
FIG. 11 substantially shows a second marker in the first image plane.

To achieve the required minute of angle parameters without excessive cost or weight penalties, the powered ocular group 30 may incorporate additional calibration features. A marker 45 may be provided in the first image plane reticle 26, as shown in FIG. 10. The marker 45 may be visible or detectable by the photosensor board 31 but is not visible to the human eye or within the light spectrum range of night vision devices such as the powered ocular group 30. That is, the marker 45 is not visible to the user during general operation or use of the riflescope. In the example of FIG. 10, the marker 45 is a cross shape in the center of the visible cross hair 40. In an alternative embodiment depicted in FIG. 11, the marker 45 may comprise four disc shaped markers 48 at the edges of the cross hair wires. The marker 45 may be provided at various positions and in various forms on the first reticule 26. Alternatively more than one marker may be used. Alternatively the whole reticle surface acts as a marker surface.

The marker material 45 may be a passive marker, i.e. non-battery activated, such as tritium, strontium-aluminate or other luminescent substance. Alternatively or in addition, the marker 45 may be an active marker that is activated by electricity, light rays or other activators. The crosshair center should be identified by a sensor-software package by an illumination that does not distract the eye in any light condition, and especially not at low light when the iris is wide open. So the illumination (active or passive) is ideally not within the 400 to 700 Nanometer-Spectrum that the human eye is able to see. FIG. 3 shows the provision of a light infra-red (IR) emitting diode 39 inside the powered ocular housing 38. The diode 39 emits IR light (or alternatively UV light) toward the first image plane in order to activate the marker 45 to make the marker 45 detectable by the photosensors 31. Other activation systems will be apparent to a person skilled in the art.

The riflescope is zeroed in through the mechanical reticle like any conventional riflescope, thus locating the cross hair center (or similar aiming mark) in the correct position towards the desired basic zeroing distance.

If the marker 45 is an active marker, a calibration procedure may commence by activating the marker, such as by switching the IR diode 39 on to cause IR light to be emitted towards the 1st image plane reticle 26, thus activating the marker 45. The sensor 31 detects the light reflected by the IR-lighted reticle marker 45, or otherwise detects the passive marker and a detection software defines the location of the marker in a grid corresponding to the first image plane.

Calibration software then shifts the digital display until the digitally overlaid aiming marks of the second image plane aligns with the detected marker 45.

The detection-calibration process may be repeated either manually by commands through the control panel, or may be performed automatically, such as periodically after a defined time laps (e.g. every 15 seconds), after every round fired (e.g. accelerometer chip), after mounting the digital eye piece, or when using the click mechanism (e.g. click movement sensor).

The use of the IR marker overcomes the problem that in daylight it is difficult for software to detect the crosshair (or any physical reference points) in the 1st image plane against the ever changing background (target image). In lowest light conditions this becomes nearly impossible. Thus, the use of the IR marker and LED allows the first image plane reticle/reference points to be illuminated in a way that is more easily found by the software but that is not visible to the human eye (to avoid distraction by light impulses or blinding). In one alternative, an ultra-violet (UV) marker may be used in place of an IR marker.

In various embodiments, the secondary superimposed aiming mark may be manually or automatically adjusted to a visual holdover position according to ballistic functions and or to a visual lead position according to the prevailing wind conditions, canting of the telescope or other alignment relevant external factors.

The digital ocular may include a digital zoom function in order to increase the optical magnification performance. Software for providing digital zoom is well known in the art. Similarly, the digital ocular may incorporate known image stabilization software and known software for image capturing.

The digital ocular may include digital motion detector that silently alarms the user when movement is detected by a special software. e.g. through a smartphone in VibraCall-mode (Bluetooth).

The digital ocular may include one or more ports or sockets for communication with external devices, socket for charging (e.g. USB), Bluetooth connectivity, etc.

Figure 12:
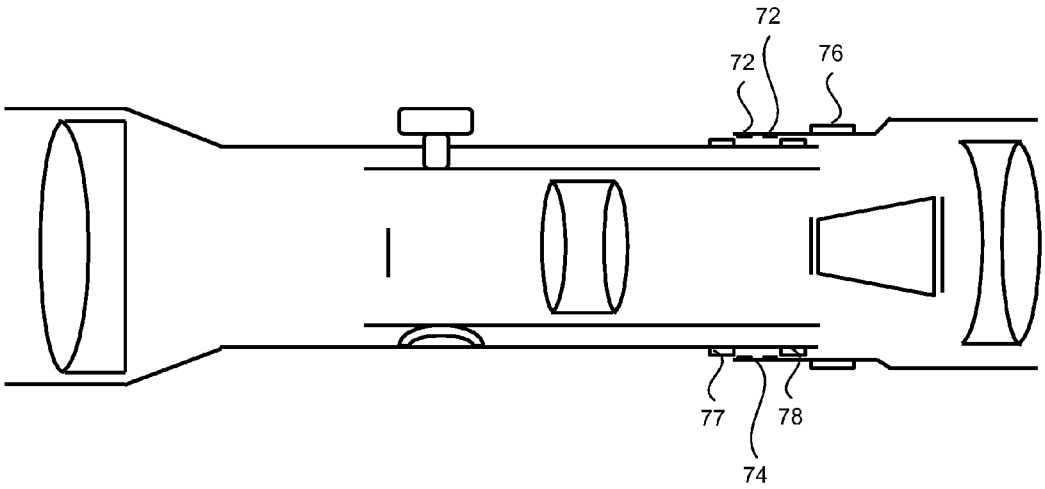
FIG. 12 substantially shows a riflescope having a universal interface in an unlocked position.
Figure 13:
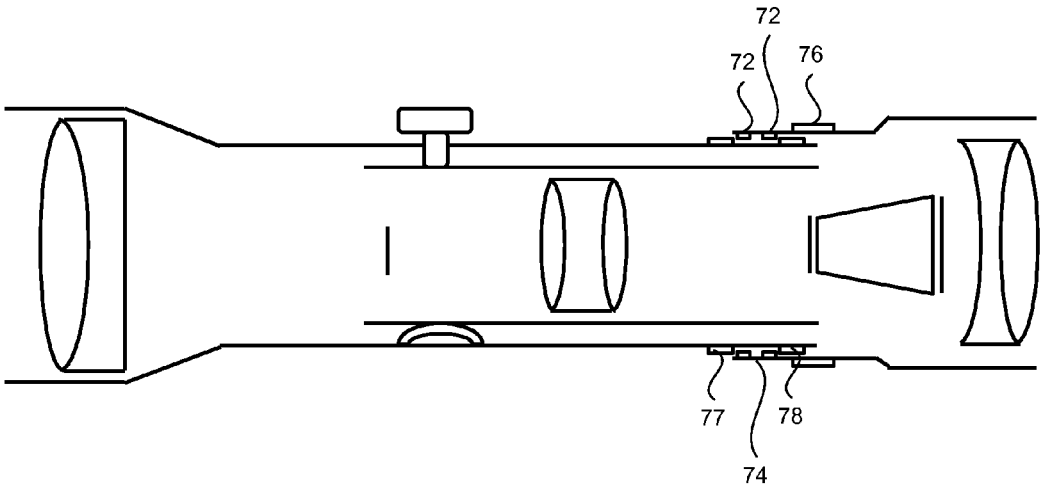
FIG. 13 substantially shows the universal interface in a locked position.

In an alternative embodiment, the ocular group, either powered or non-powered, may be fitted with a universal interface for attachment to the main scope housing 12. The universal interface is depicted in FIGS. 12 and 13. The universal interface is a slide fit and works with a large variety of housing designs within a certain class (e.g. 30 mil tubes). The 'non-threaded'/'non-bayonet'—mechanical interface is able to bridge a wide tolerance field (compared to thread- or bayonet standards). The universal interface includes one or more locking o-rings 72 within a sleeve 74 of the ocular housing. The o-rings are retained between stops 77, 78. A tightening locking ring 76 moves laterally within the sleeve 74. As the locking ring 76 moves within the sleeve, it compresses the o-rings 72 causing the o-rings to expand radially (FIG. 13), thereby providing engagement between the internal sleeve wall of the ocular housing and the outer surface of the main housing. Further description of the universal interface is provided in the Applicant's co-pending patent application titled "Scope Attachment", the entire contents of which are incorporated herein by reference.

An advantage of the universal interface is that it can reduce cost for riflescope manufacturers to develop a riflescope that can adapt to the concepts described herein.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A riflescope comprising: (A) a main housing, (B) an objective group comprising at least one objective lens, the objective group disposed toward an objective end of the main housing; (C) a first reticle comprising at least one physical reticle mark; (D) a detachable digital ocular group comprising: (a) a second housing attachable to and detachable from an ocular end of the main housing; (b) a photo-sensor, (c) at least one processor; (d) a digital display; (e) a power supply for powering at least one of the at least one processor and the digital display; (f) wherein the photo-sensor is configured to receive light that has entered the objective end of the main housing, wherein the photo sensor terminates a light path of the light that has entered the objective end of the main housing such that there is no complete light path through the digital ocular group, wherein the processor is programmed to display a representative reproduction of the light recorded by the photo-sensor onto the digital display, wherein the first reticle comprises at least one marker detectable by the at least one processor through the photo-sensor, and wherein the at least one marker is not visible to the user through an ocular end of the riflescope.

2. The riflescope of claim 1 wherein the detachable digital ocular group is replaceable with an unpowered ocular group comprising a third housing attachable to and detachable from an ocular end of the main housing and one or more second ocular optical elements disposed within the third housing.

3. The riflescope of claim 1 comprising an erector group comprising at least one optical erector element.

4. The riflescope of claim 1 wherein the first reticle comprises one or more marker materials that are not visible to an operator of the riflescope during normal use of the riflescope.

5. The riflescope of claim 1 wherein the detachable digital ocular group comprises one or more ocular optical elements for magnification of the digital display for projection to the user through an ocular end of the second housing.

6. The riflescope of claim 1 wherein the digital display comprises a low light level mode that reduces the light output of the digital display to avoid blinding a user's eye in lowest light conditions.

7. The riflescope of claim 1 wherein the at least one processor is programmed to digitally overlay the at least one physical reticle mark with one or more secondary aiming marks at the photo-sensor.

8. The riflescope of claim 7 wherein the at least one processor is programmed to suppress the at least one physical reticle mark.

9. The riflescope of claim 1 wherein the at least one marker comprises an active marker that is activated by at least one activator.

10. The riflescope of claim 9 wherein the active marker comprises at least one infra-red marker, the detachable digital ocular group comprising at least one infra-red light source that can be selectively activated to illuminate the at least one infra-red marker.

11. The riflescope of claim 1 wherein the at least one processor is programmed to perform a calibration procedure comprising:

(A) receiving light from the marker into the photo-sensor;

(B) processing, by the processor, the light received by the photo-sensor to detect a location of the marker;

(C) calibrating, by the processor, the digital display from the detected location of the marker.

12. The riflescope of claim 11 wherein the calibration procedure comprises activating the marker.

13. The riflescope of claim 11 wherein the processor is programmed to automatically perform the calibration periodically.

* * * * *